US005824362A

United States Patent [19]

Watanabe

[11] Patent Number: 5,824,362

[45] **Date of Patent: *Oct. 20, 1998**

[54] PLATEMAKING PROCESS FOR PERFORATING STENCIL PRINTING SHEET

[75] Inventor: Hideo Watanabe, Tokyo, Japan

[73] Assignee: Riso Kagaku Corporation, Tokyo, Japan

[ * ] Notice: The term of this patent shall not extend beyond the expiration date of Pat. No. 5,669,300.

[21] Appl. No.: 779,920

[22] Filed: Jan. 9, 1997

Related U.S. Application Data

[63] Continuation of Ser. No. 284,174, Aug. 2, 1994, abandoned.

[30] Foreign Application Priority Data

Aug. 4, 1993 [JP] Japan ..... 5-193638

[51] Int. Cl.[6] ..... B05D 1/00; B41N 1/24; B41C 1/14

[52] U.S. Cl. ..... 427/143; 427/273; 101/128.21; 101/128.4

[58] Field of Search ..... 427/273, 143, 427/336; 101/128.21, 128.4

[56] References Cited

U.S. PATENT DOCUMENTS

| | | | |
|---|---|---|---|
| 2,069,576 | 2/1937 | Cohen | 358/297 |
| 3,209,686 | 10/1965 | Arthurs | 101/368 |
| 4,597,829 | 7/1986 | Sato et al. | 156/644 |
| 5,417,156 | 5/1995 | Tateishi et al. | 101/128.21 |

FOREIGN PATENT DOCUMENTS

| | | | |
|---|---|---|---|
| 2206704 | 5/1974 | France . | |
| 456101 | 2/1928 | Germany . | |
| 51-2513 | 1/1976 | Japan | 101/128.21 |
| 61-12387 | 1/1986 | Japan | 101/128.4 |
| 61-12395 | 1/1986 | Japan | 101/128.4 |
| 125237 | 4/1928 | Switzerland . | |
| 558605 | 1/1944 | United Kingdom . | |
| 2209018 | 4/1989 | United Kingdom . | |

*Primary Examiner*—Shrive Beck
*Assistant Examiner*—Fred J. Parker
*Attorney, Agent, or Firm*—Fay, Sharpe, Beall, Fagan, Minnich & McKee

[57] ABSTRACT

A process for platemaking a stencil printing sheet having a solvent-soluble resin layer wherein a solvent is selectively fed to the resin layer so that only the solvent contacts a surface thereof thereby perforating the solvent-soluble layer.

9 Claims, No Drawings

PLATEMAKING PROCESS FOR PERFORATING STENCIL PRINTING SHEET

This is a continuation of application Ser. No. 08/284,174 filed on Aug. 2, 1994 abandoned.

BACKGROUND OF THE INVENTION

1. Field of the Invention

The present invention relates to a platemaking process for a stencil printing sheet. Specifically, it relates to a platemaking process for a stencil printing sheet which can perforate the stencil printing sheet without bringing the stencil printing sheet in contact with a platemaking machine.

2. Description of the Prior Art

In a prior art, as for a platemaking process for a stencil printing sheet, the following methods have been known; (1) a process of writing letters or drawing pictures with a steel or ball pen on a stencil printing sheet prepared by impregnating a porous paper with a wax, to remove the wax portion corresponding to the letters or pictures; and (2) a process of melt-perforating a thermoplastic resin film of a heat-sensitive stencil sheet consisting of a thermoplastic resin film and a porous substrate by means of the heat from a flash lamp, infrared lamp or thermal head.

However, the first (1) method requires manual operation resulting in low platemaking efficiency. Therefore, a large number of plates cannot be prepared quickly.

On the other hand, the second method uses the processes of (A) superimposing a hand written or preliminarily prepared manuscript on a heat-sensitive stencil sheet, and then melt-perforating a thermoplastic resin film using heat generated from e.g. flash pump, infrared lamp, and; (B) bringing a thermal head, which generates dot-like heat in accordance with electrical signals from letter or picture information, in contact with a heat-sensitive stencil sheet thereby melt-perforating a thermoplastic resin film of the sheet.

However, process (A) is disadvantageous since the manuscript has to be replaced every time each platemaking is completed. Moreover, the operational property is inferior since the power consumption by the lamp is large.

Process (b) is disadvantageous since the molten material of the thermoplastic resin film is left in a porous substrate and the ink permeability is prevented, resulting in the inability to produce quality printed matters, although process (B) produces operational benefits when compared to process (A). Furthermore, in process (B) it is necessary to let a heat-sensitive stencil sheet sufficiently contact the thermal head using a strong pressure resulting in the disadvantage that thin heat-sensitive stencil sheets crumpled easily, resulting in printing failure.

SUMMARY OF THE INVENTION

It is, accordingly, a main object of the present invention to provide a platemaking process for a stencil printing sheet so that the above-mentioned problems of the prior art may be solved, there may be no need of preliminarily preparing for manuscripts at a time of platemaking; the consumables, such as lamp and others, may be unnecessary; a heat-sensitive stencil sheet may hardly be crumpled; there may be no sheet loss; and a brilliant printed matter may be obtained.

The invention to be claimed mainly in this application will be as follows:

(1) A platemaking process for a stencil printing sheet comprising steps of:

providing a stencil printing sheet comprising a solvent-soluble resin layer; and feeding a solvent to the predetermined surface portion of the solvent-soluble resin layer by a solvent feed means positioned in non-contact with said surface portion, to perforate the surface portion of said resin layer.

A stencil printing sheet to be used in a platemaking process of the present invention may be composed of only a resin layer, such as a resin film produced by the film formation of a solvent-soluble resin. From the viewpoint of securing a certain strength as a stencil printing sheet, it is preferably composed of a solvent-soluble resin layer and a porous substrate. As a method for forming a resin layer on a porous substrate, a method of laminating a resin film or the like on a porous substrate and a method of coating a resin solution dissolved or dispersed in a solvent on a substrate or impregnating the substrate with the resin solution and then drying the resulting substrate, are exemplified.

A solvent-soluble resin layer contains a thermoplastic resin having a solubility in the solvent or thermosetting resin as a main component thereof. Once a solvent which dissolves the resin is fed to the surface of the resin layer by a solvent feed means which will be described later, the resin in the solvent-supplied portion starts dissolving into the solvent and is dissolved in the solvent up to the saturation of a resin solubility in the solvent. The resulting solution which dissolves the resin permeates into the interior of the porous substrate and the resin layer is perforated. In the absence of the porous substrate, the solution which dissolves the resin is wiped off by a sponge, e.g., to perforate the resin layer. The perforation of the resin layer can be adjusted by controlling both a resin solubility to the solvent for the resin layer and a quantity of solvent to be fed.

As for a resin for the solvent-soluble resin layer, a water-soluble resin, that is a resin soluble in water or in a water-miscible solvent, such as polyvinyl alcohol, methyl cellulose, carboxymethyl cellulose, hydroxyethyl cellulose, polyvinyl pyrolidone, polyethylene-polyvinyl alcohol copolymer, polyethylene oxide, polyvinyl ether, polyvinyl acetal, polyacrylamide, starch, dextrin, alginic acid, ascorbic acid or water-base urethane, a resin soluble in an organic solvent, such as polyethylene, polypropylene, iso-butylene, polystyrene, polyvinyl chloride, polyvinylidene chloride, polyvinyl fluoride, polyvinyl acetate, acryl resin, polyacrylonitrile, polyamide, polyimide, petroleum resin, phenolic resin, amino resin, expoxy resin, polyester, polycarbonate, polyurethane, polysulfone, silicone resin, alkyd resin, melamine resin, or the like may be used. The resins may be used independently or in admixture thereof.

The thickness of the solvent-soluble resin layer is preferably in the range of 0.1 $\mu$m–100 $\mu$m, and more preferably, in the range of 1 $\mu$m–50 $\mu$m. When the thickness thereof is less than 1 $\mu$m, the strength of the resin layer becomes insufficient and when it exceeds 50 $\mu$m, a large quantity of the solvent which dissolves the resin layer may be required and the perforation by dissolving the resin layer often becomes insufficient. Furthermore, dyestuffs, pigments, fillers, binders and curing agents can be contained in the resin layer described above, if necessary.

There is no particular limitation to the porous substrate to be adhered to the solvent-soluble resin layer. For example, known porous substrates, such as polyester fibers cloth, Japanese paper and the like, can be used.

The solvent used in the platemaking process of the invention may be properly chosen depending on the component of the resin layer. As such solvents, water, aliphatic hydrocarbons, aromatic hydrocarbons, alcohols, ketones, esters, ethers, aldehydes, carboxylic acids, amines, and lower molecular weight heterocyclic compounds are usable. Specifically, hexane, heptane, octane, benzene, toluene, xylene, methyl alcohol, ethyl alcohol, isopropyl alcohol, n-propyl alcohol, butyl alcohol, ethylene glycol, diethylene glycol, propylene glycol, glycerine, acetone, methylethyl ketone, ethyl acetate, propyl acetate, ethyl ether, tetrahydrofuran, 1,4-dioxane, formic acid, acetic acid, propionic acid, formaldehyde, acetaldehyde, methylamine, ethylene diamine, dimethyl formamide, pyridine, ethylene oxide and the like can be used preferably. These solvents can be used independently or in admixture of two or more solvents, and if necessary, dyestuffs, pigments, fillers, binders, hardeners, antiseptics, wetting agents, surfactants, pH conditioners, and others can be contained in the solvent.

In the present invention, the solvent is fed to the predetermined surface portion of the resin layer described above in a non-contact condition by a solvent feed means with correspondence to a letter and picture information.

There is no particular limitation to the solvent feed means so long as it can feed a solvent without being in contact with the surface of the resin layer. There is exemplified such an apparatus as that a nozzle, a slit, an injector, a porous material, a porous film or the like is connected to a piezoelectric element, a heating element or a liquid feed pump so as to release the solvent intermittently or continuously in a dot or line pattern, according to a a letter and picture signal. The space between a solvent feed port of the solvent feed means and a stencil printing sheet may be properly determined depending on the feed means and the output of the solvent discharge.

According to the present invention, the solvent which perforates a resin layer is fed to a stencil printing sheet in a non-contact condition with a solvent feed means, and therefore, there is no generation of wrinkles in the obtained plate at a time of platemaking, resulting in preventing any sheet loss. Differently from a conventional heat-sensitive stencil sheet, no molten material is left in the sheet of the invention at a time of platemaking, and therefore, the ink permeability is improved and a brilliant printed matter can be obtained.

The stencil printing sheet engraved by the process of the invention can be applied to a general stencil printing process to obtain a printed matter. For example, a printed matter can be obtained by mounting an ink on a stencil printing sheet after platemaking, passing the ink through each portion perforated by press rolls, reduced pressure means or squeegee rolls, and transcribing the ink to a printing paper. As a printing ink, an oily ink usually used in stencil printing, water-base ink, water-in-oil emulsion ink, oil-in-water emulsion ink, and others can be used.

DETAILED DESCRIPTION OF THE PREFERRED EMBODIMENTS

EXAMPLE 1

A stencil printing sheet having a solvent-soluble resin layer was obtained by coating a resin solution consisting of polyester resin (polyethylene terephthalate resin) of 20 weight parts, toluene of 50 weight parts and ethyl acetate of 30 weight parts, on a polyester fiber cloth having a sieve opening of 200 mesh with a roll coater, and drying, to form a resin layer of 5 $\mu$m in thickness on the polyester fiber cloth.

A mixture solution of toluene of 50 weight parts, 1,4-dioxane of 30 weight parts and methyl ethyl ketone of 20 weight parts was ejected in a letter shape to the surface of the resin layer of the stencil printing sheet by using a liquid discharging apparatus equipped with a nozzle of 8 dots/mm connected to a piezoelectric element. The resin layer portion where the mixture solution was ejected, dissolved and perforated.

Subsequently, after superimposing a printing paper on the resin layer of the stencil printing sheet, a black water-in-oil emulsion ink was mounted on the side of the polyester fibers and squeegeed by a blade, resulting in printing on the printing paper the similar letters to those of the perforated portions.

EXAMPLE 2

Following the similar procedure as described in Example 1, with the exception of using a liquid feed apparatus equipped with a nozzle of 12 dots/mm connected to a piezoelectric element, a stencil printing sheet was prepared for platemaking and then a stencil printing was carried out. As a result, the resin layer in contact with the mixture solution was dissolved and perforated. A printing was carried out by using the perforated plate, resulting in obtaining the similar letters to those of the perforated portions.

EXAMPLE 3

A mixture solution consisting of methylethyl ketone of 50 weight parts, toluene of 30 weight parts and isopropyl alcohol of 20 weight parts was charged into an ejector and then ejected in a pictorial pattern to the surface of polycarbonate film of 10 $\mu$m in thickness. The film brought in contact with the mixture solution was dissolved in the pictorial pattern and perforated.

Subsequently, after superimposing a printing paper on the film thus perforated, a black water-in-oil emulsion ink was mounted on the other film surface and squeegeed by a blade, resulting in printing thereon the similar pictorial pattern to that of the perforated portion.

EXAMPLE 4

A porous film of 0.5 mm in thickness and having pores having an average pore size of 50 $\mu$m was impregnated with the mixture solution used in Example 3, and the resulting impregnated porous film was arranged at an interval of 2 mm from the surface of a polycarbonate film of 10 $\mu$m in thickness. The porous film impregnated with the mixture solution was heated to eject the mixture solution from the film to the surface of the polycarbonate film to perforate it, resulting in printing in the similar manner as described in Example 3 to obtain a good printed matter.

EXAMPLE 5

A Japanese paper having a basis weight of 10 g/m$^2$ was superimposed on a polyvinyl ether film of 7 $\mu$m in thickness, and the superimposed film was passed through the heat rollers at a temperature of 120° C. to prepare a stencil printing sheet having a solvent-soluble resin layer.

Then, a mixture solution consisting of isopropyl alcohol of 20 weight parts, ethylene glycol of 5 weight parts and water of 75 weight parts was supplied to the ink feed portion in an ink jet printer instead of ink, and then ejected from the nozzle of this ink jet printer to the surface of the polyvinyl ether film of the stencil printing sheet, with correspondence to the letter and picture information prepared by a personal computer. The polyvinyl ether film corresponding to the portion in contact with the mixture solution was dissolved and perforated.

Subsequently, the sheet thus perforated was mounted on PRINT GOKKO PG-10 (a portable stencil printing device of Riso Kagaku Corporation, Trademark) to carry out a stencil printing, resulting in printing brilliantly the letters and pictures prepared by the personal computer.

EFFECT OF THE INVENTION

According to the platemaking process of the present invention, a stencil printing sheet can be perforated in a non-contact condition thereof. Therefore, there is no need of preparing any manuscripts in advance, and there is also no generation of wrinkles at a time of platemaking, resulting in preventing any sheet loss. Since the resin layer of a stencil printing sheet is perforated by dissolving it, no molten material is not left in the porous substrate differently from the conventional heat-sensitive stencil sheet. Therefore, the ink permeability is improved and a brilliant printed matter can be obtained.

What we claimed is:

1. A platemaking process for perforating a stencil printing sheet comprising the steps of:

providing a stencil printing sheet comprised of a layer of a solvent-soluble resin selected from the group consisting of a polyester, polycarbonate and polyvinyl ether; and feeding a solvent comprising at least one organic solvent selected from the group consisting of alcohols, ketones, and esters, to a portion of said solvent-soluble resin layer using a solvent feed means positioned in the non-contact with said portion thereby perforating the portion of said solvent soluble resin layer.

2. The platemaking process for perforating the stencil printing sheet according to claim 1, wherein said stencil printing sheet further comprises a porous substrate on which the solvent-soluble resin layer is provided.

3. The platemaking process for perforating the stencil printing sheet according to claim 1, wherein said solvent-soluble resin layer is polyester resin and said solvent is a mixture of toluene, dioxane and methylethyl ketone.

4. The platemaking process for perforating the stencil printing sheet according to claim 1, wherein said solvent-soluble resin layer is polycarbonate resin and said solvent is a mixture of methylethyl ketone, toluene and isopropyl alcohol.

5. The platemaking process for perforating the stencil printing sheet according to claim 1, wherein said solvent-soluble resin layer is polyvinyl ether and said solvent is a mixture of isopropyl alcohol, ethylene glycol, and water.

6. The platemaking process for perforating the stencil printing sheet according to claim 2, wherein said solvent-soluble resin layer is polyester resin and said solvent is a mixture of toluene, dioxane and methylethyl ketone.

7. The platemaking process for perforating the stencil printing sheet according to claim 2, wherein said solvent-soluble resin layer is polycarbonate resin and said solvent is a mixture of methylethyl ketone, toluene and isopropyl alcohol.

8. The platemaking process for perforating the stencil printing sheet according to claim 2, wherein said solvent-soluble resin layer is polyvinyl ether and said solvent is a mixture of isopropyl alcohol, ethylene glycol, and water.

9. A platemaking process for perforating a stencil printing sheet comprising the steps of:

providing a stencil printing sheet comprised of a layer of a solvent-soluble resin selected from the group consisting of a polyester, polycarbonate and polyvinyl ether on a porous substrate; and feeding a solvent comprising at least one organic solvent selected from the group consisting of alcohols, ketones and esters to a surface of a portion of said solvent-soluble resin layer using solvent feed means, to dissolve the portion of said solvent-soluble resin layer and to permeate into an interior of said porous substrate, thereby perforating the portion of said solvent-soluble resin layer.

* * * * *